US011440692B2

(12) United States Patent
Crivolio et al.

(10) Patent No.: US 11,440,692 B2
(45) Date of Patent: Sep. 13, 2022

(54) PATTERNED CUT POUCH FORMING MACHINE, AND METHOD

(71) Applicant: Mespack Cloud, LLC, Des Plaines, IL (US)

(72) Inventors: Anthony Crivolio, Elk Grove Village, IL (US); Alexander Waterman, Mount Prospect, IL (US); Donn D. Hartman, Hawthorn Woods, IL (US); Argenis Almodovar, Addison, IL (US)

(73) Assignee: Mespack Cloud, LLC, Des Plaines, IL (US)

( * ) Notice: Subject to any disclaimer, the term of this patent is extended or adjusted under 35 U.S.C. 154(b) by 24 days.

(21) Appl. No.: 17/178,454

(22) Filed: Feb. 18, 2021

(65) Prior Publication Data

US 2021/0261282 A1 Aug. 26, 2021

Related U.S. Application Data

(60) Provisional application No. 63/004,988, filed on Apr. 3, 2020, provisional application No. 62/979,174, filed on Feb. 20, 2020.

(51) Int. Cl.
*B65B 47/10* (2006.01)
*B65B 9/04* (2006.01)
(Continued)

(52) U.S. Cl.
CPC ..... *B65B 47/10* (2013.01); *B65B 9/04* (2013.01); *B65B 41/16* (2013.01); *B65B 61/08* (2013.01); *B65B 2009/047* (2013.01)

(58) Field of Classification Search
CPC ..... B65B 9/04; B65B 9/042; B65B 41/16; B65B 47/10; B65B 61/08; B65B 2009/047
(Continued)

(56) References Cited

U.S. PATENT DOCUMENTS 2,497,212 A 2/1950 Donofrio
2,513,852 A 7/1950 Donofrio
(Continued)

FOREIGN PATENT DOCUMENTS

EP 0 188 832 A2 7/1986
EP 0 257 990 A2 3/1988
(Continued)

OTHER PUBLICATIONS

European Patent Office, International Search Report in European Patent Application No. PCT/US2021/018454 (dated May 26, 2021).
(Continued)

*Primary Examiner* — Stephen F. Gerrity
(74) *Attorney, Agent, or Firm* — Leydig, Voit & Mayer, Ltd.

(57) ABSTRACT

Apparatus for forming product containing pouches from a travelling web of adhered films includes a film support surface, including a plurality of mold configurations, and a film retention chamber in the film support surface preceding and trailing each of the mold configurations. A vacuum system applies vacuum to the mold configurations and film retention chambers to form product containing pockets and to secure the film in the film retention chambers. Separation blades in synchronous register with the mold configurations separate the pouches from the travelling web. In one form the film support surface comprises a rotary forming drum and a rotary blade drum includes the separation blades.

13 Claims, 10 Drawing Sheets

(51) Int. Cl.
*B65B 41/16* (2006.01)
*B65B 61/08* (2006.01)

(58) Field of Classification Search
USPC ..... 53/453, 559
See application file for complete search history.

(56) References Cited

U.S. PATENT DOCUMENTS

| | | | | |
|---|---|---|---|---|
| 2,813,799 | A * | 11/1957 | Bender et al. | B65B 9/042 229/123.2 |
| 3,126,681 | A * | 3/1964 | Cloud | B65B 47/10 53/579 |
| 3,218,776 | A | 11/1965 | Cloud | |
| 3,757,620 | A | 9/1973 | Cloud | |
| 4,271,739 | A | 6/1981 | Chung | |
| 4,571,924 | A * | 2/1986 | Bahrani | B65B 9/042 53/579 |
| 4,608,895 | A | 9/1986 | Bell et al. | |
| 5,192,484 | A | 3/1993 | Matuzawa et al. | |
| 5,366,685 | A | 11/1994 | Fujii et al. | |
| 5,459,980 | A | 10/1995 | Kenney et al. | |
| 6,085,626 | A | 7/2000 | Pfaff, Jr. | |
| 8,662,880 | B2 | 3/2014 | Fowler et al. | |
| 9,162,413 | B2 | 10/2015 | Hartman et al. | |
| 2005/0115935 | A1 | 6/2005 | Edwards et al. | |
| 2009/0288367 | A1 | 11/2009 | Granili et al. | |
| 2015/0065323 | A1 | 3/2015 | Hartman et al. | |
| 2015/0336691 | A1 | 11/2015 | Fowler et al. | |
| 2016/0068285 | A1 * | 3/2016 | Fowler et al. | B65B 9/042 53/558 |
| 2018/0133919 | A1 | 5/2018 | Waterman et al. | |
| 2018/0141737 | A1 | 5/2018 | Secchi et al. | |

FOREIGN PATENT DOCUMENTS

| | | | |
|---|---|---|---|
| EP | 2 834 154 | B1 | 4/2014 |
| GB | 2314312 | A | 12/1997 |
| JP | 2005014211 | A | 1/2005 |
| WO | WO 2017/064211 | A1 | 4/2017 |
| WO | WO 2018/031488 | A1 | 2/2018 |

OTHER PUBLICATIONS

European Patent Office, Written Opinion in European Patent Application No. PCT/US2021/018454 (dated May 26, 2021).
Response to Written Opinion in European Patent Application No. PCT/US2021/018454 (dated Dec. 16, 2021).
European Patent Office, Written Opinion in European Patent Application No. PCT/US2021/018454 (dated Jan. 24, 2022).
Response to Second Written Opinion in European Patent Application No. PCT/US2021/018454 (dated Mar. 24, 2022).

* cited by examiner

PATTERNED CUT POUCH FORMING MACHINE, AND METHOD

CROSS-REFERENCE TO RELATED APPLICATIONS

This application claims priority, pursuant to Title 35 U.S.C. § 119(e) to U.S. provisional application Ser. No. 62/979,174, filed Feb. 20, 2020, for "Improvements in Patterned Cut Device and Method," and U.S. provisional application Ser. No. 63/004,988, filed Apr. 3, 2020, for "Patterned Cut Pouch Forming Machine and Method." The specification and drawings of the foregoing applications are hereby incorporated herein by reference as if fully set forth.

BACKGROUND

This disclosure relates to manufacture of pressurized flexible, composition containing pouches formed of polymeric film and the apparatus and method for making them. More particularly, it is related to mechanism for producing and separating completed pouches from a travelling web of adhered films and the associated method of doing so.

Flexible pouches made of polymeric film and filled with a consumable product are commonly produced on equipment having an array of pouch forming mold configurations. These pouch forming mold configurations are often incorporated into a rotating drum, or axially movable platen. Examples of such forming, filling and sealing systems include U.S. Pat. No. 3,218,776, issued Nov. 23, 1965 to Charles E. Cloud, and U.S. Pat. No. 9,162,413, issued to Cloud Packaging Solutions, LLC, the entire contents of which are hereby incorporated herein by reference as if fully set forth.

Machines or systems are known for forming flexible sealed pouches or packages containing a consumable product. Such pouches may be made from two continuous films in which a first or base film is vacuum formed into mold configuration cavities on a rotating forming drum to define pockets to be filled with one or more products or materials and subsequently closed by a second or lid film. On release of a completed pouch from its mold cavity, the known shrinkage of the base film and complementary stretch or expansion of the lid film cause the resultant internal pressurization of the pouch and ultimate shape of a completed pouch. Some more recent configurations include multiple compartment pouches, and pouches in which more than two films are employed.

A known two-layer pouch may be made of polyvinyl alcohol (PVA) or similar soft, deformable and water soluble polymeric material. It includes one or more product-containing chambers within a perimeter seal seam defined by the edge of pouch mold configurations on a film support surface of a forming drum or platen. Typically, the process for separation of the completed pouches from the web of adhered films results in creation of a perimeter flange about the seal seam that has a rectangular or square perimeter edge configuration.

Traditionally, the formed and filled pouches are cut from the continuous web of adhered films using stationary slitting blades that cut the moving web into longitudinal strips. Thereafter, rotating transverse blades cut the strips between rows of pouches to separate the strips into individual pouches. The result is a filled pouch with a perimeter flange of surrounding material comprising adhered layers of film having a rectangular or square perimeter edge. A modern example of such a machine and process for forming such pouches is disclosed in previously identified U.S. Pat. No. 9,162,413. (See also U.S. Pat. No. 3,218,776.)

The foregoing process is particularly suitable for producing flexible packages from water soluble film, such as polyvinyl alcohol (PVA). A highly successful application involves manufacture of individual dosage pouches of liquid laundry detergent and/or liquid dish washing detergent, though other commercial applications are also known.

The industry has, for some time, contemplated production of formed filled and sealed pouches with a more cost effective, or attractive shape, particularly, a pouch with a unique surrounding perimeter flange. U.S. patent application Ser. No. 15/812,601, filed on Nov. 14, 2017, Patent Publication No. 2018/0133919 A1, published May 17, 2018, entitled "Machine for Cutting Pouches with Shaped Perimeter Edge, Method and Pouch," discloses a pouch forming machine capable of providing pouches having an other than a rectangular-shaped perimeter edge flange. The apparatus there disclosed employs a rotary blade drum assembly with blade portions that coact with the film support surface mold configurations to separate pouches along the entire perimeter edge of the perimeter flange of the pouch. The entire specification and drawings of that application are incorporated by reference into this disclosure, as if fully set forth herein.

The evolution of commercial apparatus for separating pressurized pouches from a travelling web of adhered films using a rotary knife operating in association with the film support surface has brought forth a recognition of the need to stabilize the pouch position relative to the coacting separation elements. This recognition has been particularly significant in relation to the need to overcome the effects on pouch position of internal pressure within the pouch on termination of vacuum to the mold cavities and film tension due to elastic deformation.

SUMMARY OF DISCLOSURE

Accordingly, this disclosure emphasizes structure and methodology to ensure structural and aesthetic integrity of the resultant pouches. Integral to this accomplishment is the maintenance of pouch position and shape relative to the elements of the separation apparatus.

This disclosure provides mechanism and method for separating pouches that attain the foregoing goals. In particular, it provides the capability to produce pouch shapes having non-rectangular perimeter edges resulting in unique and attractive pouch shapes that were heretofore unobtainable. The principles here disclosed are applicable to multiple forms of pouch making mechanisms, including rotary drum and flat platen machines.

Apparatus disclosed for forming product containing pouches from a travelling web of adhered films includes a film support surface, having a plurality of mold configurations, and a film retention chamber in the film support surface preceding and trailing each of the mold configurations. A vacuum system applies vacuum to the mold configurations and film retention chambers to form product containing pockets and to secure the film in the film retention chambers. Separation blades in synchronous register with the mold configurations separate the pouches from the travelling web. In one form the film support surface comprises a rotary forming drum and a rotary blade drum includes the separation blades.

DETAILED DESCRIPTION OF THE DRAWINGS

DETAILED DESCRIPTION OF THE ILLUSTRATED EMBODIMENTS

In this disclosure, longitudinal means along the length of the travelling web of film or films. Transverse or lateral means across the film from edge-to-edge. In connection with the base forming drum, inward means toward the axis of rotation of the drum. Circumferential means about the circumference of the outer generally cylindrical film support surface of the drum. Transverse means parallel to the rotational axis of the drum. Downstream means in the direction of travel of the film. A leading edge or trailing edge is used in its usual context of the direction of movement or advancement.

Figure 1:
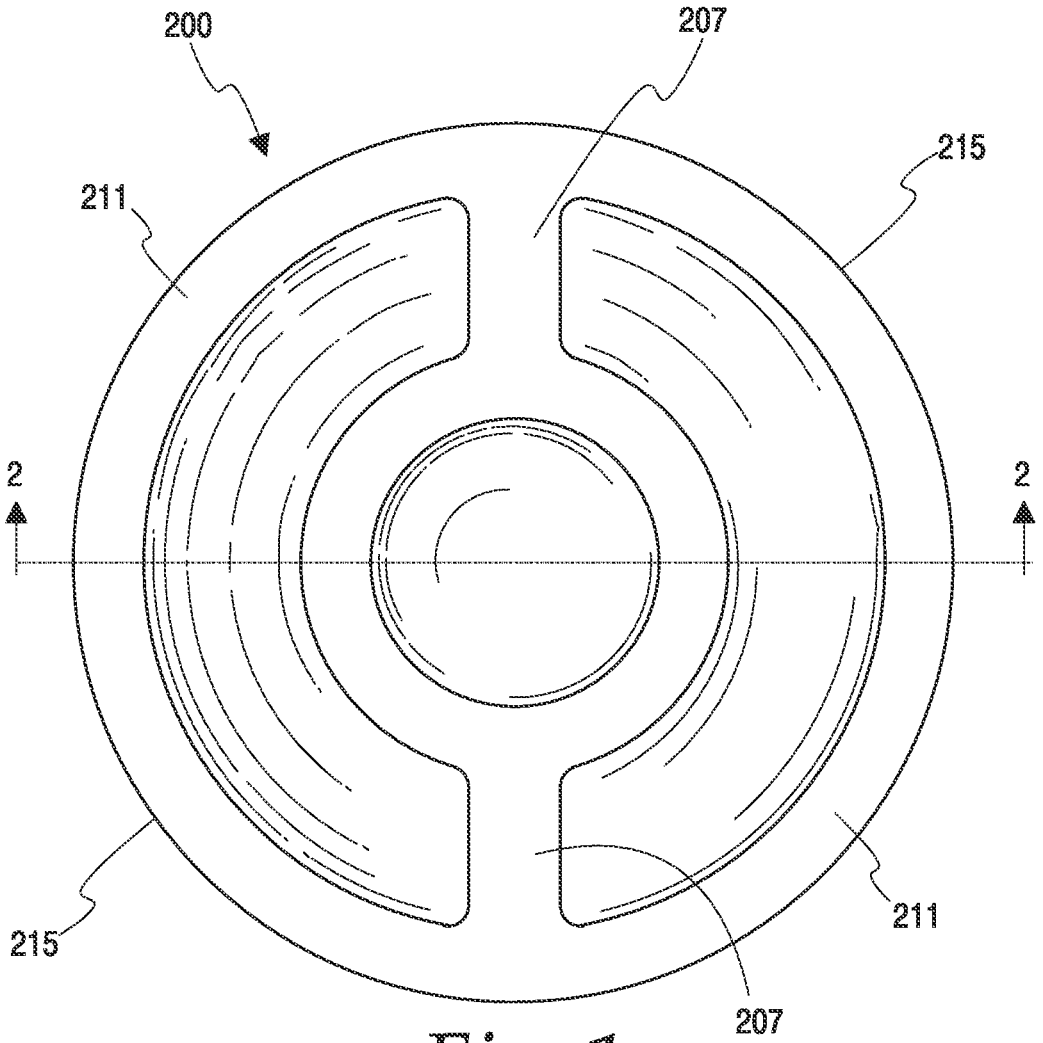
FIG. 1 is a top view of a flexible product containment pouch configuration made in accordance with the disclosure.
Figure 2:
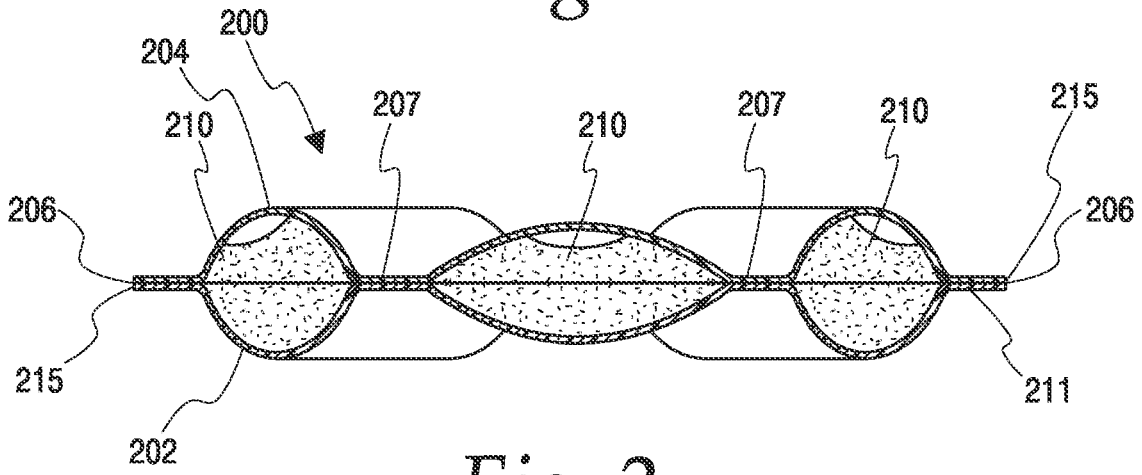
FIG. 2 is a cross-sectional view of the pouch of FIG. 1 taken along the line 2-2 of FIG. 1.

Turning now to the drawings, FIGS. 1 and 2 are illustrative of a flexible containment pouch 200 formed by joinder of two polymeric films and produced in accordance with this disclosure. The films could be water soluble polyvinyl alcohol, though other films could be used. The films used are "soft" and form "soft" blisters once thermoformed from PVA, polyethylene, or other suitable polymeric film.

Typical film thicknesses for soft blister pouches are 0.001" (inch) to 0.004" (inch) thick. The formed stock, sometimes called the base film, is typically around 0.003" (inch) thick. The lid stock or lid film may be thinner, for example, around 0.002" (inch) thick. These thicknesses may vary and are not requisite for the principles of this disclosure.

Referring to FIGS. 1 and 2, pouch 200 includes a base film 202 and a lid film 204 joined along a sealed interface 206 of adhered films. It defines a hollow interior volume containing a product component 210, in this illustration, a liquid composition.

The pouch 200 has a generally circular perimeter flange 211 of adhered films with a circular perimeter edge 215. The illustrated pouch 200 has an overall diameter at perimeter edge 215 of about 2½" (inch) (63.5 mm.). The surrounding flange has a width of 0.16" (inch) (4 mm.). This pouch shape is, of course, merely illustrative and not limiting.

Three separate interior volumes or chambers are separated by webs 207 of adhered films 202 and 204. Each separate volume contains a product component 210, which may be the same or a different composition, usually a liquid, or other suitable material, such as granular or powdered material.

Pouches formed of polymeric material, such as polyvinyl alcohol, are prone to shrinkage and distortion after forming, filling and sealing. When located in the mold cavity, an applied vacuum from the machine vacuum system retains the shape dictated by the mold configuration. Once vacuum is terminated, however, the pouch base pocket changes shape due to recovering film tension. Because the pouch 200 is sealed, the base film shrinkage is accommodated through stretching of lid film 204 to form the final shape. Often lid film 204 is a thinner material than base film 202 to augment the expansion characteristics of the lid film.

Pouch 200 of FIGS. 1 and 2 is only illustrative. The principles disclosed herein have a wide range of applicability and benefit for production of a wide variety of shaped pouches, including square or rectangular shaped pouches and also shapes not previously attainable.

Figure 3:
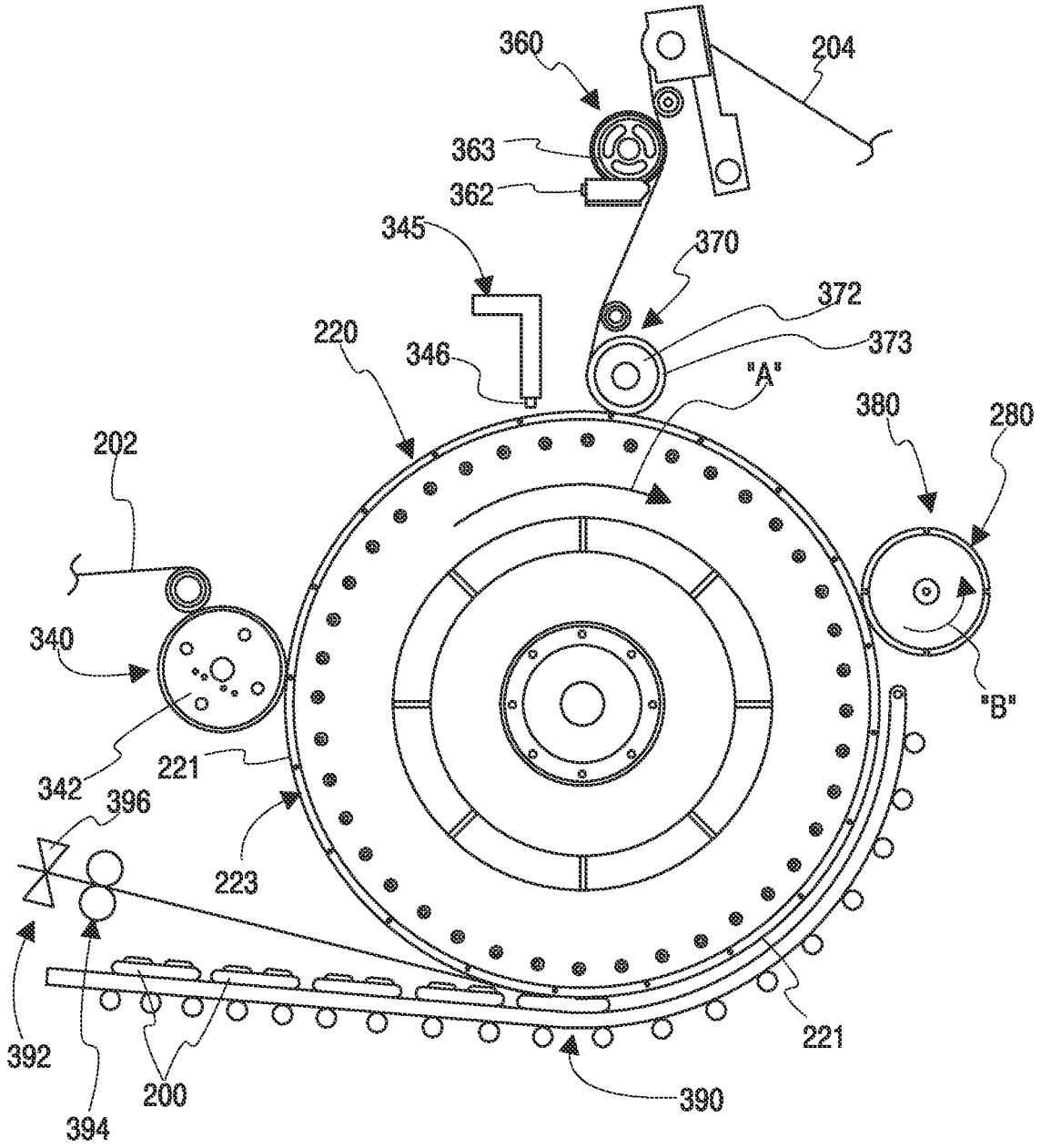
FIG. 3 is a schematic view of an exemplary rotary drum form, fill and seal machine for making pouches in accordance with this disclosure.

FIG. 3 is a schematic representation of a rotary pouch forming and filling apparatus or machine suitable for producing a plurality of the pouches 200 depicted in FIGS. 1 and 2, in accordance with the principles of the present disclosure. The pouch forming apparatus is generally similar to that disclosed in aforementioned U.S. Pat. No. 9,162,413 and Publication No. 2018/0133919. Of course, the principles disclosed are fully applicable to other pouch forming apparatus, including, but not limited to, movable platen machines.

A rotatable base forming drum 220, having an outer generally cylindrical film support surface 223, includes multiple transverse rows of pouch forming mold configurations 224 defining mold cavities to produce multiple pouches simultaneously. Typically, the rotary drum 220 comprises a plurality of combined long bars 221 assembled to form a wheel. The outer generally cylindrical film support surface of the combined bars 221 is best reflected by generally cylindrical end portions 219, seen in FIGS. 4 and 5. Each bar 221 includes multiple mold configurations or cavities 224 extending inward of the drum from outer film support surface 223.

A supply roll of continuous film material provides the base film 202. It is delivered to base forming drum 220 from a film heater system and overlies the transverse extent of generally cylindrical film support surface 223, including portions of generally cylindrical end portions 219. End portions 219 may include vacuum ports 217, seen in FIGS. 4 and 5, in communication with the machine vacuum system to assure a reliable retention of base film 202 to the rotating drum 220. A drive system (not shown) is operatively connected to the base forming drum 220 to rotate the drum continuously about its axis in direction "A" in FIG. 3.

The wheel, comprising drum 220, also carries concentrically disposed circular vacuum distribution plate 222, seen in FIGS. 5, 7 and 11, and described in further detail below in connection with vacuum system 250.

Referring to FIG. 3, similar to pouch forming apparatus currently in commercial use, such as disclosed in U.S. Pat. No. 9,162,413, the pouch forming apparatus additionally includes vacuum system 250, a heater system 340, a product feed mechanism 345, a wetting system 360, a sealing system 370, a pouch separation station 380, and the rolls of material that supply base film 202, and lid film 204. The illustrated machine also includes a processed film disposal system 392, which accumulates the travelling web of films 202 and 204 after removal of the completed pouches 200. (See FIG. 3).

Figure 7:
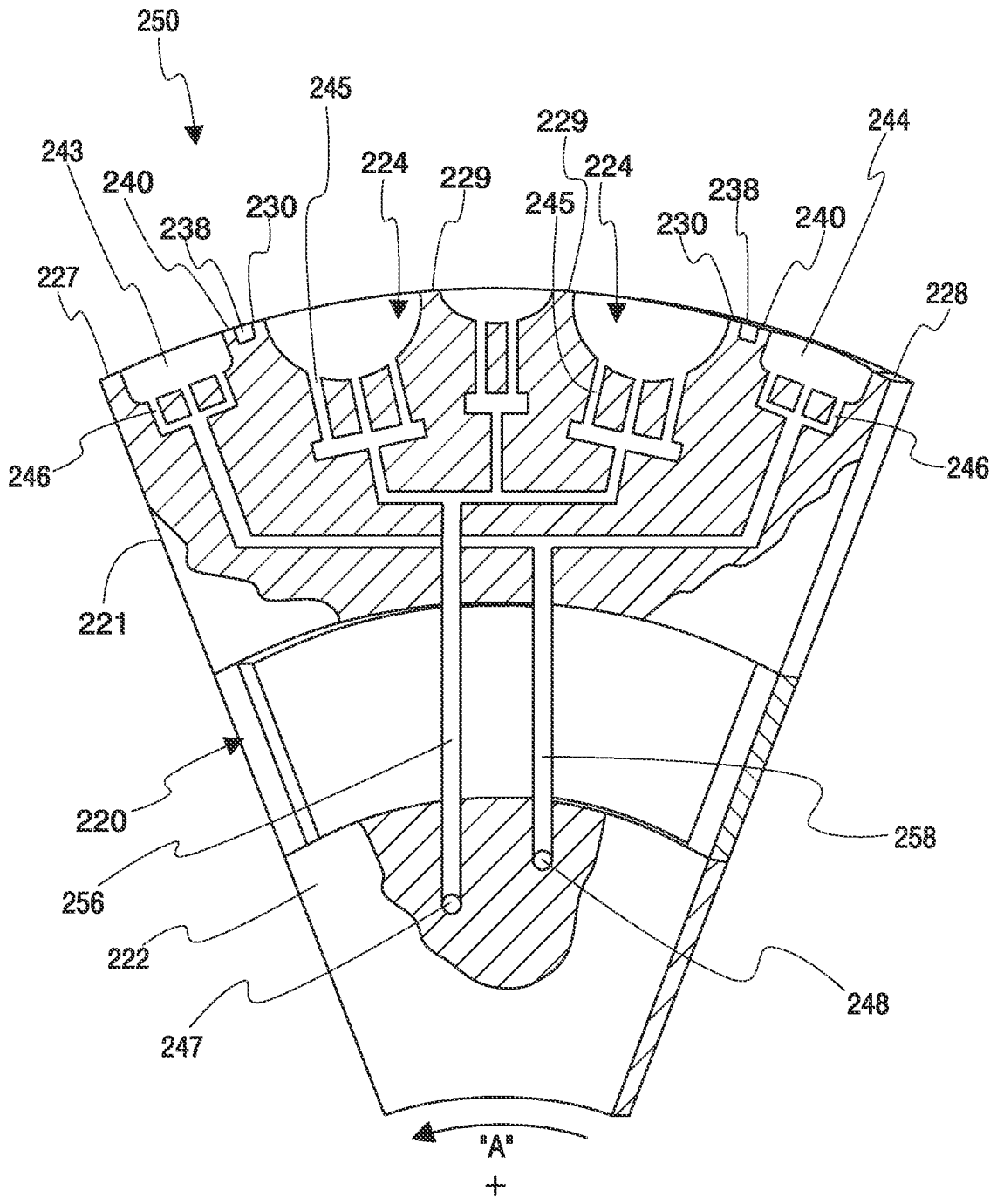
FIG. 7 is a fragmentary schematic view of rotary portions of the vacuum system, of the machine of FIG. 3.
Figure 8:
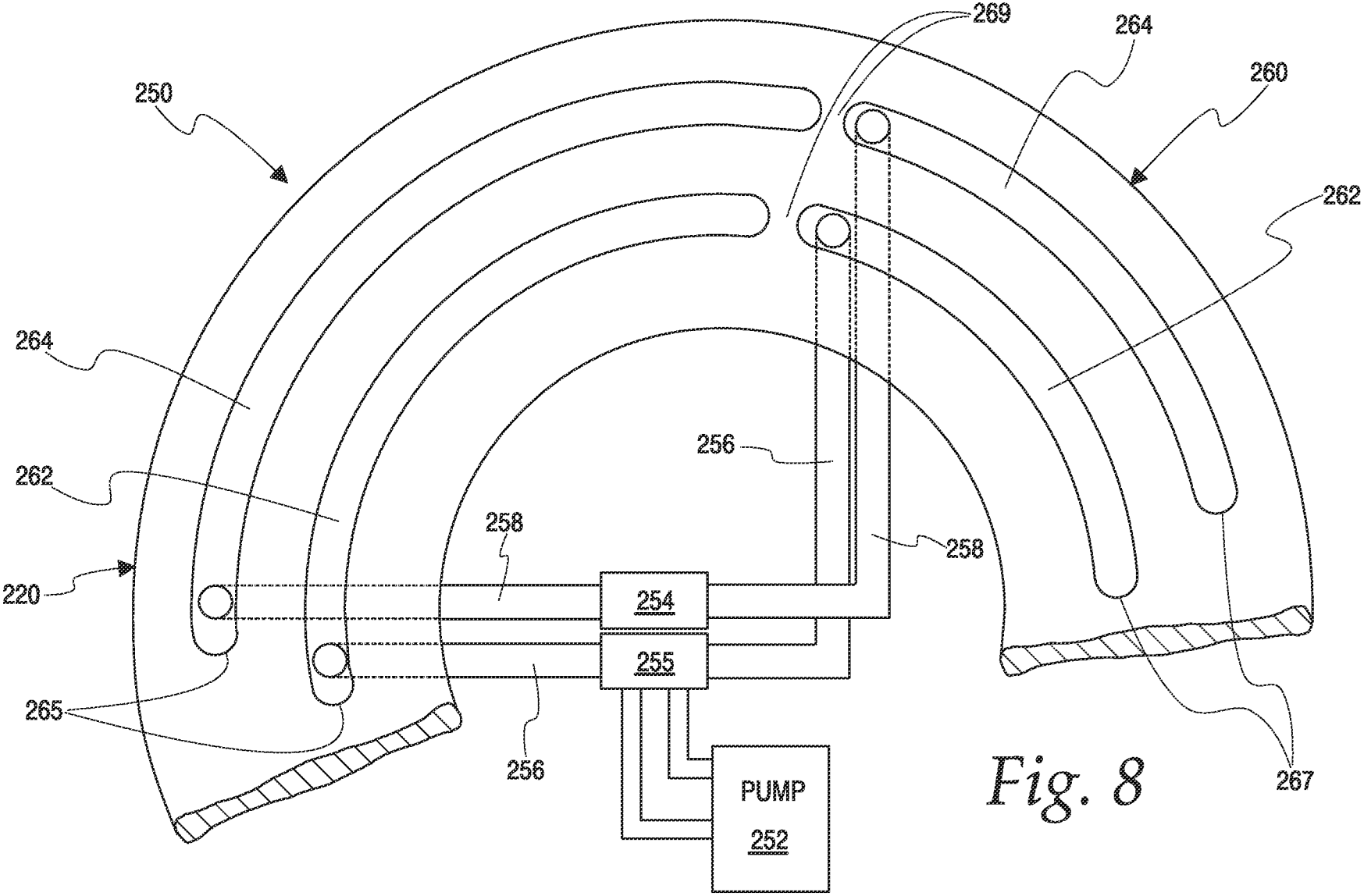
FIG. 8 is a fragmentary schematic view of stationary portions of the vacuum system of the machine of FIG. 3.

Elements of the vacuum system 250, as shown in FIGS. 7 and 8. As in prior known pouch forming machines, the vacuum system is operatively connected to each mold configuration 224 to provide a vacuum to draw a portion of the base film 202 into the mold cavities to form product receiving pockets in base film 202. The vacuum is maintained throughout the forming, filling and separation of the pouches to ensure alignment of the film components with the functional elements of the machine. Such a vacuum system is well known in the art. In this disclosure of a pouch making machine, vacuum system 250 is more complex and provides a further function, as will be explained.

The heater system 340 is depicted as a rotatable base film heater roller 342 positioned adjacent the base forming drum 220. It includes an internal element to heat the base film 202 prior to it contacting the film support surface 223 of base forming drum 220 or being drawn into mold configurations 224 to form product pockets. The heater system 340 may be configured as a cartridge-type heater within the base film heater roller 342 but other types of heaters, either internal or external to a roller, may be used if desired. In a typical method of thermoforming, for example, PVA or similar film, on a rotary drum form fill and seal pouch machine, the film is heated to a range of 140° F. to 400° F. depending on film thickness, type of film and other operational parameters.

A product feed mechanism 345 is positioned generally adjacent the base forming drum 220 to supply one or more product components into each chamber of the product pocket as the base film 202 moves along with the film support surface 223 of rotating drum 220. Product feed mechanism 345 may include multiple feed nozzles 346 to deliver product, such as a liquid, to individual chambers of a multiple chamber pouch, as is well known in the art and may take any known form. Such mechanisms may also be configured to feed any desired type of composition, number or combination of individual products and/or materials, preferably including a liquid composition. Of course the product could comprise any suitable combination of a gel, a solid, a powder, a paste or wax-type product, pills, tablets, or even other pouched products.

A supply roll of continuous film material provides the lid film 204. The lid film 204 is aligned with the base film 202 so as to come into overlying contact with the base film 202 after the filling of the formed pockets of the base film within mold configurations 224. The illustrated lid wetting system 360 helps create a strong seal between the base film 202 and lid film 204. It is positioned adjacent the lid film 204 at a position upstream of where the lid film 204 seals to the base film 202 at the base forming drum 220.

The lid wetting system 360 may apply a solvent to the lid film 204 to increase its tackiness to assist in adhering the lid film 204 to the base film 202. To do so, the solvent may be provided through a wetting reservoir 362 to a wetting roller 363 that engages the lid film 204. In instances where the base film 202 and lid film 204 are formed of a polyvinyl alcohol material, the solvent for the lid wetting system 360 may be water.

A sealing system 370 having a sealing roller 372 is positioned in close contacting relation to the film support surface 223 of base forming drum 220. Lid film 204 passes around sealing roller 372 and is urged into sealing contact with base film 202 to urge the contacting surfaces of base film 202 and lid film 204 into adhering, sealed relation. In this regard, the sealing roller 372 is mounted such that it applies pressure to the overlying films to perfect the sealing relationship. Sealing roller 372 may include an outer layer 373 formed of material that is deformable, such as a rubber or similar material, though this is not essential. Typically, this material has a thickness of about one-half inch (½") and a durometer of about 60, though these values may vary. The material, and the pressure exerted on the overlying films, assures effective contact of base film 202 and lid film 204 along the sealed interface 206. Of course, depending on the film material, it is also known to use heat, ultrasonic welding or other similar process to seal the lid film and base film together to form a completed pouch.

The foregoing mechanism is typical of rotary form fill and seal pouch forming machine with a base forming drum producing a travelling web of adhered films interspersed with filled product component chambers. The description to follow describes apparatus and method in accordance with this disclosure for separation of the product component pouches from the travelling web. This apparatus and method provide the capability to produce individual pouches of unique configurations, which, in this illustration, is circular.

A pouch separation station 380 is located after, or downstream from the location at which the base film 202 and the lid film 204 are secured together to form the web of adhered films. It comprises a rotary blade drum assembly 280 configured in accordance herewith to coact with the base forming drum 220 to individually separate each completed pouch 200 from the travelling web of adhered films.

The cooperative machine elements and their functional coaction are illustrated and described in detail below in relation to production of the unique pouch configuration illustrated in FIGS. 1 and 2. The surrounding flange 211 of this pouch has a circular perimeter edge 215. The disclosed apparatus and method, however, possess the capability to produce any number of variations of pouches with flanges having myriad perimeter edge configurations, including typical pouches with rectangular-shaped perimeter seal flanges.

Figure 4:
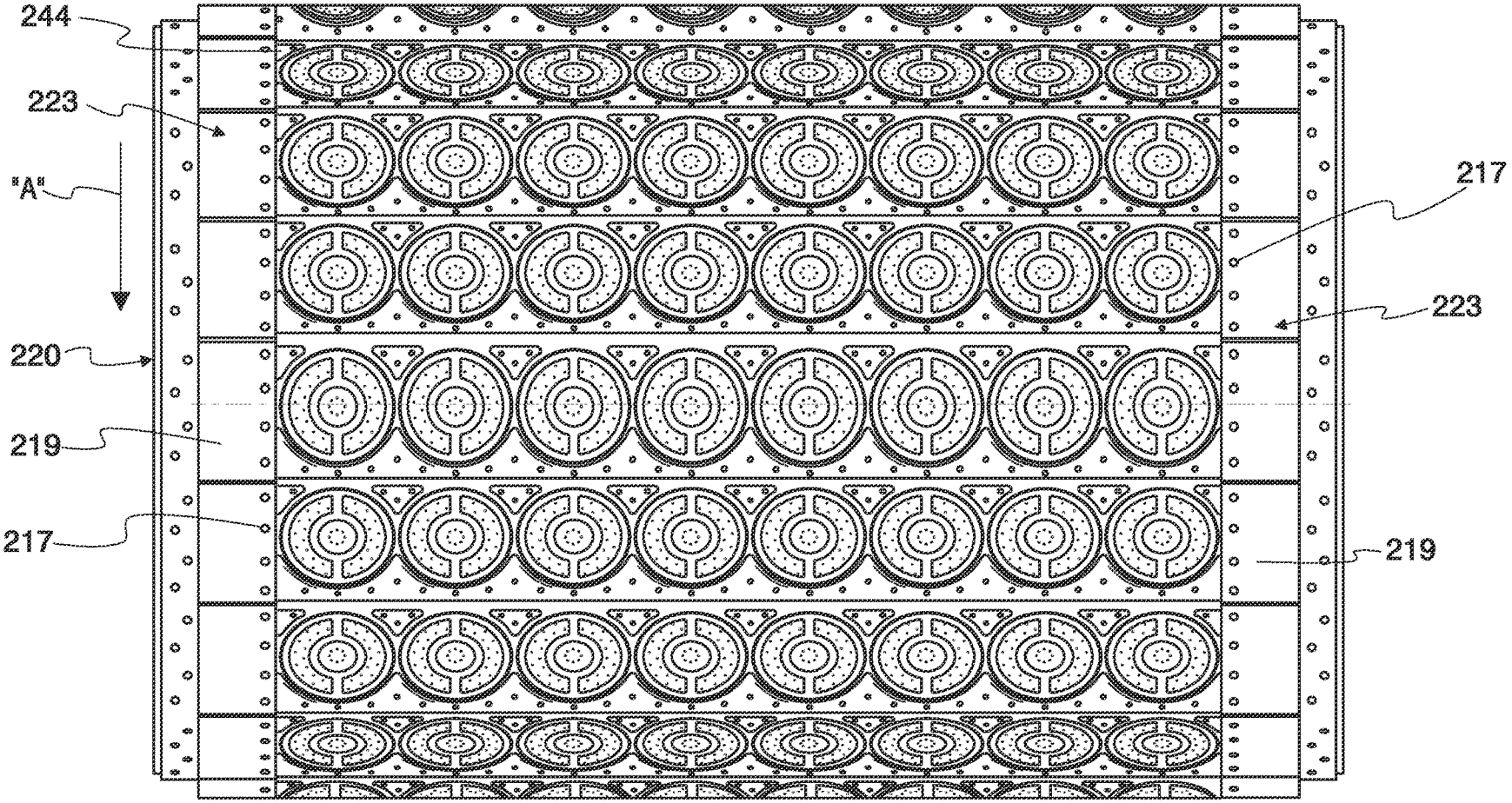
FIG. 4 is a plan view of the rotary base forming drum of the machine of FIG. 3.
Figure 5:
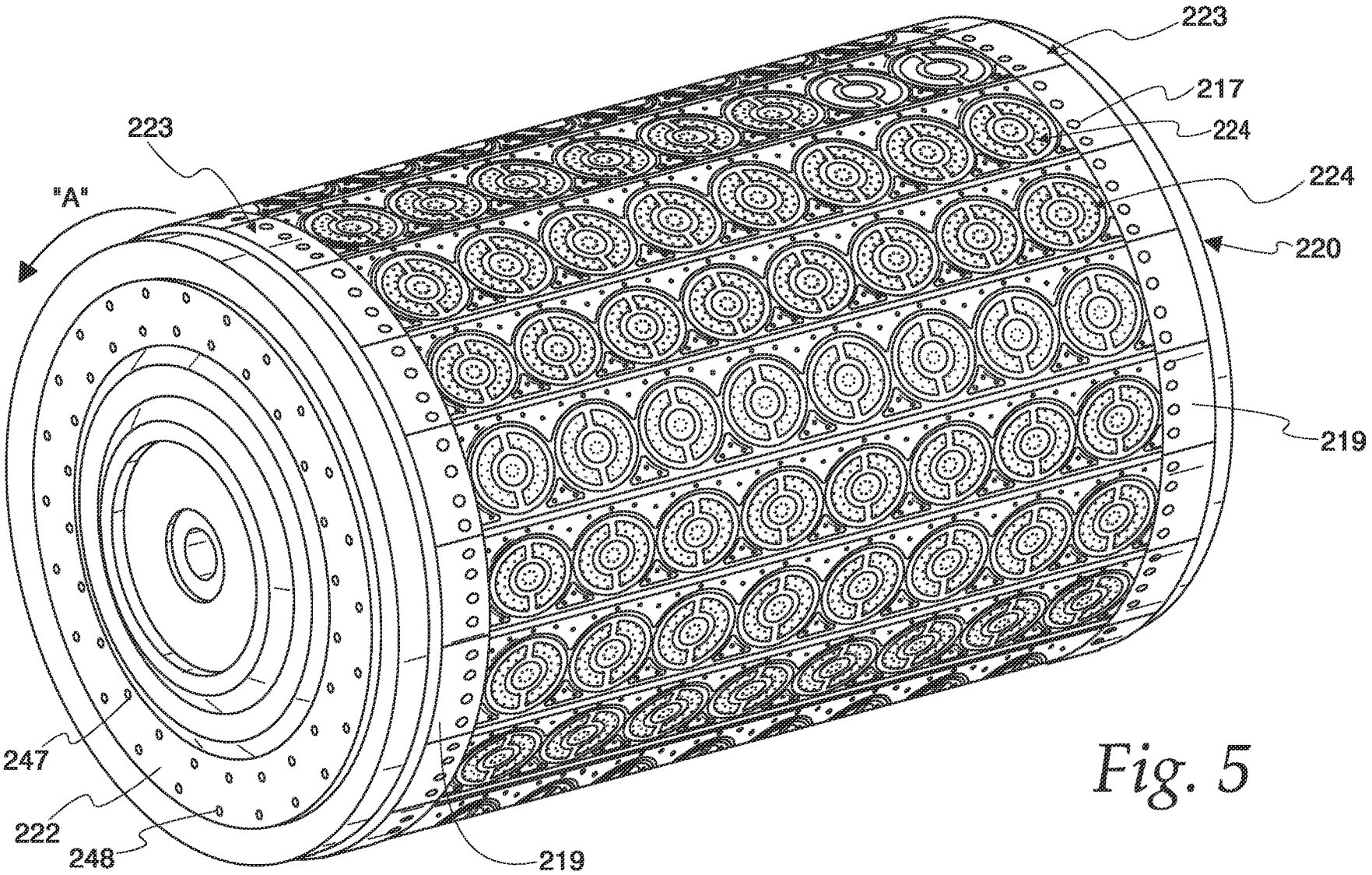
FIG. 5 is a perspective end view of the rotary base forming drum of FIG. 3.

A key component of the disclosed separation system is base forming drum 220, seen in FIGS. 3 to 6. As previously described, base forming drum 220 includes smooth cylindrical outer film support surface 223 defined by the exterior surface of assembled long bars 221. The bars 221 are segments of a circle, assembled to form the cylindrical drum, as illustrated in FIGS. 3 to 5. Each bar extends transversely of the drum parallel to the axis of rotation, between a bar leading edge 225 and bar trailing edge 226. Leading edge lands 227 and trailing edge lands 228 at each leading and trailing edge 225 and 226 comprise portions of the outer film support surface 223 of drum 220.

As illustrated, each long bar 221 includes a transverse row of mold configurations 224. Each mold configuration 224 defines a mold cavity surrounded by continuous perimeter land 230. Each cavity is divided into multiple chambers by divider lands 229. With the long bars assembled, as shown in FIGS. 4 and 5, the mold configurations 224 are arranged in circumferential columns about the film support surface 223.

Figure 6:
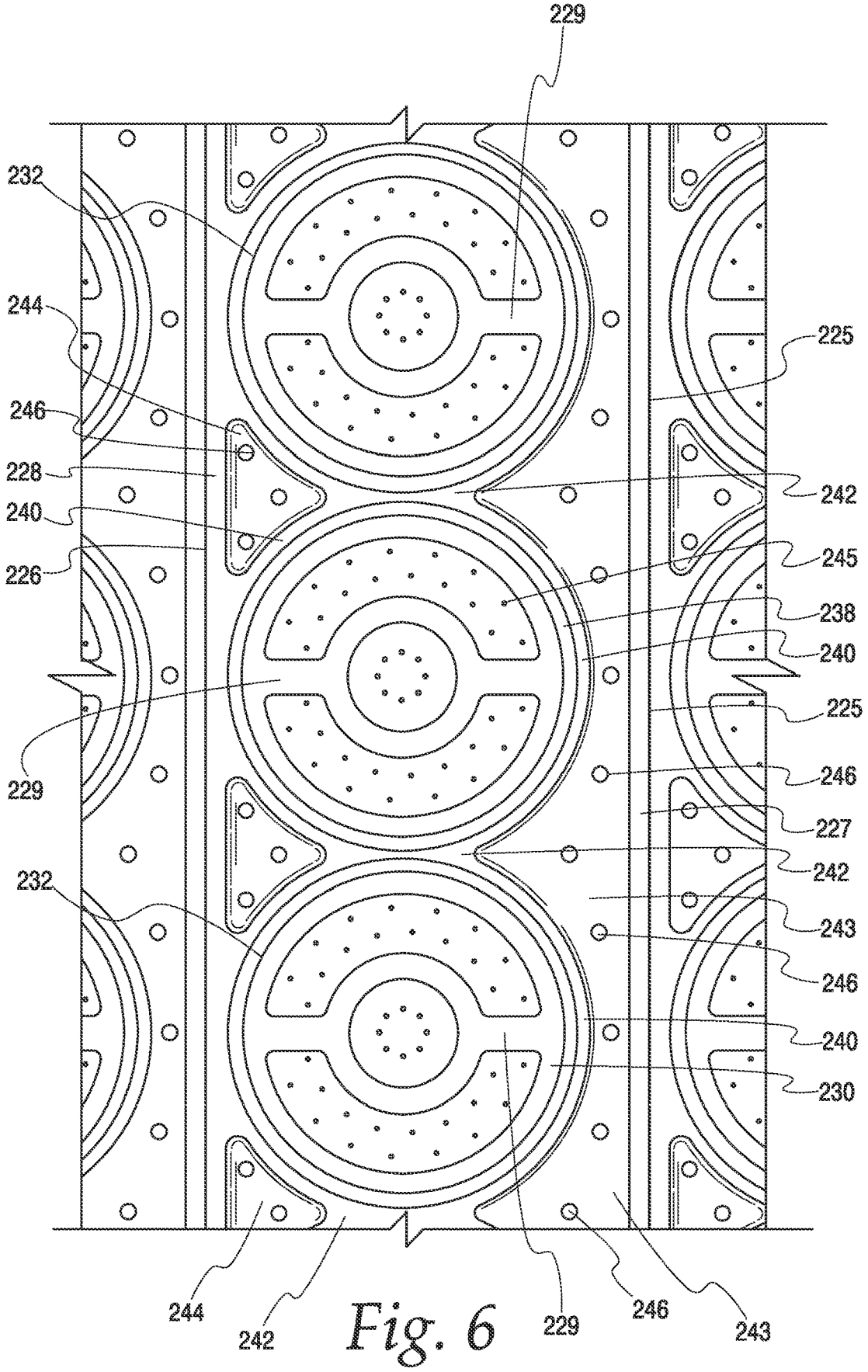
FIG. 6 is a partial plan view, on an enlarged scale, of a portion of the outer generally cylindrical base film supporting surface of the rotary base forming drum of FIG. 3 and mold configurations.

FIG. 6 is an illustration of portions of long bars 221 showing details of the mold configurations 224. Each one produces a pouch, as illustrated in FIGS. 1 and 2, having multiple chambers and a generally circular configuration with a surrounding perimeter web flange 211 of adhered films 202 and 204.

In operation, the base film 202 for a pouch is supported upon the outer film support surface 223 during the pouch forming and filling steps of the pouch making process. After filling, lid film 204 is adhered to the base film 202 in a well-known manner. Rotating base forming drum 220 carries the travelling web of adhered films through completion of the pouch forming process. The combined web of adhered films advances to the pouch separation system 380, with the completed pouches retained by vacuum within the cavities of mold configurations 224. The resultant pouch here has a perimeter flange 211 with perimeter edge 215 follows the profile of the mold configuration 224. The illustrative pouch, produced by the principles of this disclosure is a multi-compartment pouch with three separate chambers; however, the principles of this disclosure are equally applicable to single compartment pouches, as well as pouches with any number of chambers.

With reference to the mold configuration 224 of FIG. 6, mold cavity segments, or chambers, are created by divider lands 229 co-extensive with the outer film support surface 223. These cavities represent three separate chambers of the multi-chamber pouch shown in FIGS. 1 and 2 separated by adhered webs 207 of films 202 and 204.

The pouch defining chambers are encircled by continuous perimeter land 230, which is co-extensive with smooth outer film support surface 223 of base forming drum 220. Continuous perimeter land 230 includes outer perimeter edge 232. The radial extent of perimeter land 230, inward from perimeter edge 232 to the mold cavity defines the width of the surrounding web of adhered films or perimeter flange 211 of pouch 200, seen in FIGS. 1 and 2.

Referring to FIG. 6, a continuous blade groove 238 extends about outer perimeter edge 232. Groove 238, in this embodiment, circular, represents a void space surrounding the outer perimeter edge 232 of continuous perimeter land 230 of mold configuration 224. Groove 238 is provided for complementary coaction with operative elements of the pouch separation station 380, as will be explained.

A perimeter separation land 240 surrounds each groove 238, defining the radial outer extent of the blade groove 238. Land 240 is coextensive with, and forms a part of, outer film support surface 223 of base forming drum 220. Thus, as can be appreciated, base film 202 disposed upon film support surface 223, is in contact with cylindrical end portions 219, leading edge lands 227 and trailing edge lands 228, divider lands 229 continuous perimeter land 230 and perimeter separation land 240, all of which comprise the outer film support surface 223 for base film 202 on base forming drum 220.

Referring to FIG. 6, it is noteworthy that by virtue of the transverse spacing of the mold configurations 224 along each long bar 221, the perimeter separation land 240 of each mold configuration 224 merges with the perimeter separation land 240 of each adjacent mold configuration 224. Such merged lands are apparent at numeral 242 in FIG. 6. Also, it is noteworthy that continuous perimeter separation land 240 merges with trailing edge land 228.

Best seen in FIG. 6, in this illustrated embodiment, each long bar 221 is provided with a leading film retention chamber, or cavity 243, and a plurality of trailing film retention chambers or cavities 244. Leading film retention chamber or cavity 243 is defined between leading edge land 227 of bars 221 and the merged perimeter separation lands 240 of each mold configuration 221. Its transverse terminal extent is between the cylindrical film support end portions 219, best seen in FIGS. 4 and 5.

Trailing film retention chambers or cavities 244 are formed between trailing edge lands 228 and the merged perimeter separation lands 240. Trailing film retention chambers or cavity 244 adjacent cylindrical end portions 219 of film support surface 223 terminate at cylindrical end portions 219.

As will become apparent in accordance with this disclosure, the film retention chambers 243 and 244 are significant to the achievement of successful separation of completed pouches 200 from the travelling web of adhered films 202 and 204.

As seen in FIG. 6, the cavities of each mold configuration 224 include apertures or ports 245. Significant to this disclosure, leading film retention chamber 243 and trailing film retention chambers 244 each include apertures or ports 246.

FIG. 7 illustrates portions of the vacuum system 250 within drum 220. It is representative of the arrangement of each long bar 221. Ports 245 within each mold configuration 224 connect via conduits or passageways to valve ports or openings 247 in circular vacuum distribution plate 222. Ports 247 are positioned in a circular pattern concentric to the axis of rotation of drum 220, one for each long bar 221.

Ports or apertures 246 within leading film retention chamber 243 and trailing film retention chambers 244 are connected via conduits or passageways to valve ports or openings 248 positioned in a circular pattern concentric to the pattern of ports 247 on vacuum distribution plate 222, again, one for each long bar 221.

Turning now to FIG. 8, the vacuum system 250 of this disclosure includes a vacuum source or pump 252, regulators 254 and 255, connected through conduits or passages 256 and 258 to a stationary vacuum distribution plate 260 supported on the machine frame. Distribution plate 260 is provided with timing distribution grooves or slots 262 and 264. Slots 262 and 264 are complementary and cooperate with valve port openings 247 and 248 of rotating circular vacuum distribution plate 222 of rotary base forming drum 220. During operation, the rotatory plate 222 is in sliding sealed relation with stationary plate 260 along a sliding interface.

Slots 262 and 264 of stationary plate 260 are concentric arcuate segments of a circle extending from a "vacuum applied" end 265 to a "vacuum not applied" end 267. With base forming drum 220 rotatably mounted on the machine frame, slots 262 and 264, respectively, overlie valve port openings 247 and 248 and provide communication between the vacuum source, regulators 254 and 255, and ports or apertures 245 and 246, mold configurations 224 and leading and trailing edge chambers 243 and 244.

The arcuate length of slots 262 and 264 between vacuum "applied" and vacuum "not applied" ends determines the period of vacuum application at mold cavity ports or apertures 245 and ports or apertures 246 of film retention chambers 243 and 244.

Note that grooves 262 and 264 are discontinuous at ungrooved portions 269 of stationary distribution plate 260. This interruption provides isolation of the vacuum elements of bars 221 at the pouch separation station 380 from bars at the base film roller 342.

Notably, the vacuum system 250 of this disclosure includes two separate branches, one to serve as a vacuum source for the pouch cavities, or mold configurations 224 through ports 245, and another to serve as a vacuum source for leading film retention chamber 243 and trailing film retention chambers 244 through ports 246. With separate regulators 254 and 255 and separate timing distribution grooves 262 and 264 vacuum timing and intensity may be controlled independently, if desired. Notably, conduits 256 and 258 have separate connections to the separated portions of the slots 262 and 264 to ensure uniform vacuum intensity at the bars 221 undergoing disposition of film 202 on drum 220 unaffected by downstream fluctuations.

As is readily appreciated, base film 202 is subjected to vacuum within mold configurations 224 upon initial disposition of film 202 upon outer generally cylindrical film support surface 223 of base forming drum 220 at base film roller 342. Such vacuum causes the deposited film to conform to the shape of the product receiving cavities of the mold configurations 224. The vacuum is maintained throughout travel of the rotating drum from initial contact of the film 202 through each processing station, including pouch separation at separation station 380. This vacuum is impressed at ports 247 of rotating plate 222 through slot 262 connected to vacuum pump 252 through conduits or passageways 256. Vacuum timing within the mold configurations is controlled by the arcuate length between the ends 265 and 267 of groove or slot 262.

In this disclosure, vacuum of system 250 is also applied to leading film retention chamber 243 and trailing film retention chambers 244, causing base film 202 to conform to the cavities defined by these void areas of the generally cylindrical film support surface 223. As a result, the portions of base film 202 overlying perimeter separation lands 240, continuous blade grooves 238 and continuous perimeter lands 230 of mold configurations 224 are retained against dislodgement or undesirable movement.

The vacuum to leading film retention chamber 243 and trailing film retention chambers 244 is applied at ports 248 of rotating plate 222 through slot 264, connected to vacuum pump 252 by conduit or passageways 258. The position of the ends 265 and 267 of groove 264 control the vacuum timing, which is maintained throughout the pouch forming process, including separation.

The resultant stability of the web of films 202 and 204 on generally cylindrical film support surface 223 at the pouch separation station 380 enhances the capability of the separation station performance creating pouches in accordance herewith. The separation system 380, including illustrated rotary blade drum assembly 280 described below, separates each completed pouch 200 from the moving web of films 202 and 204 carried on base forming drum 220 along the entire perimeter edge 215 of circular flange 211 of each pouch 200.

Figure 9:
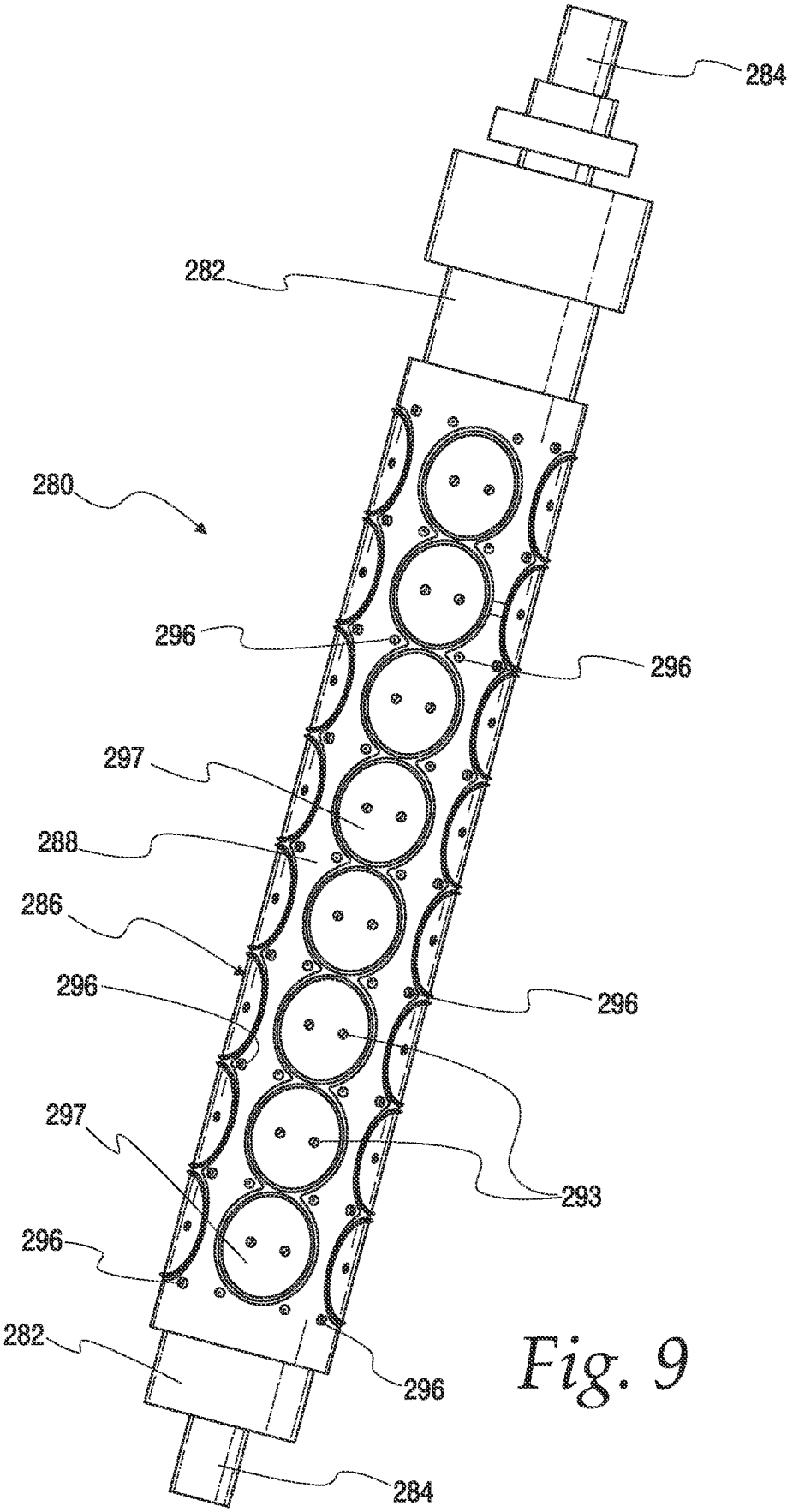
FIG. 9 is a plan view of a rotary blade drum of the pouch separation system of the machine of FIG. 3.
Figure 11:
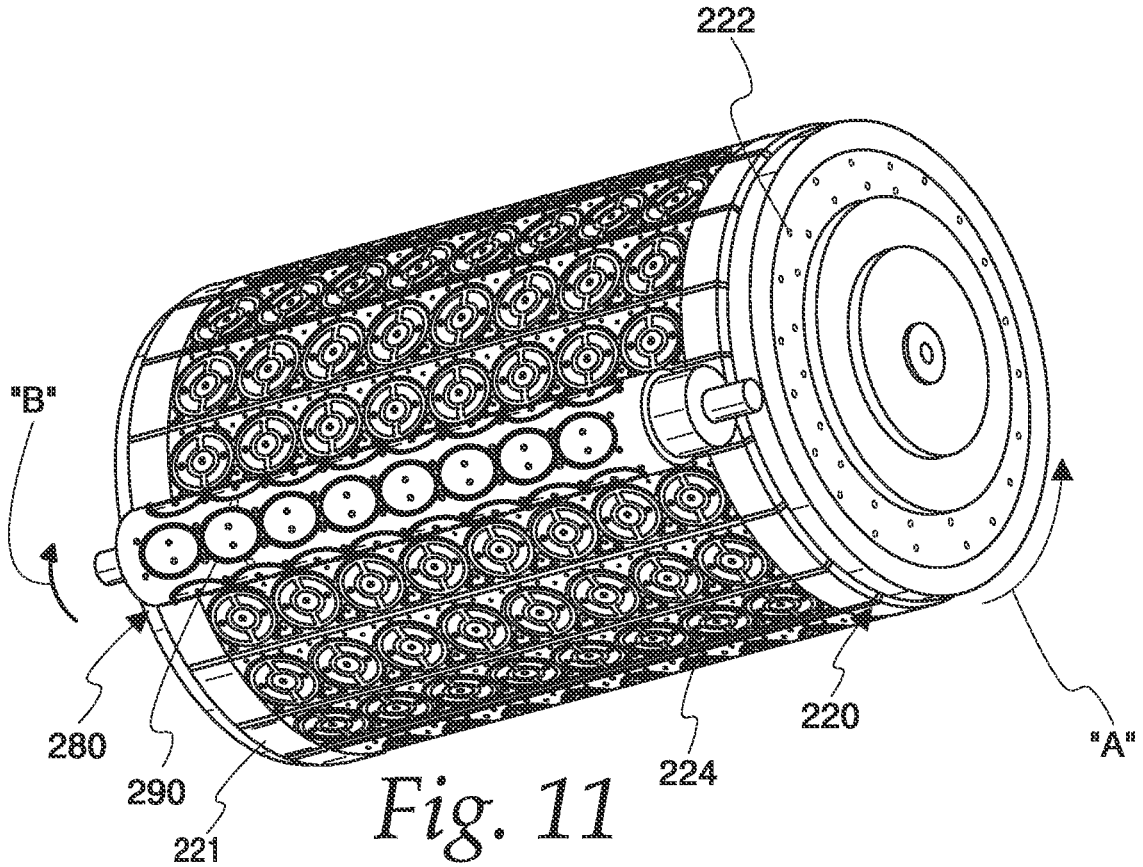
FIG. 11 is a perspective view of the base film forming drum and rotary blade drum disposed in operative relation.
Figure 10:
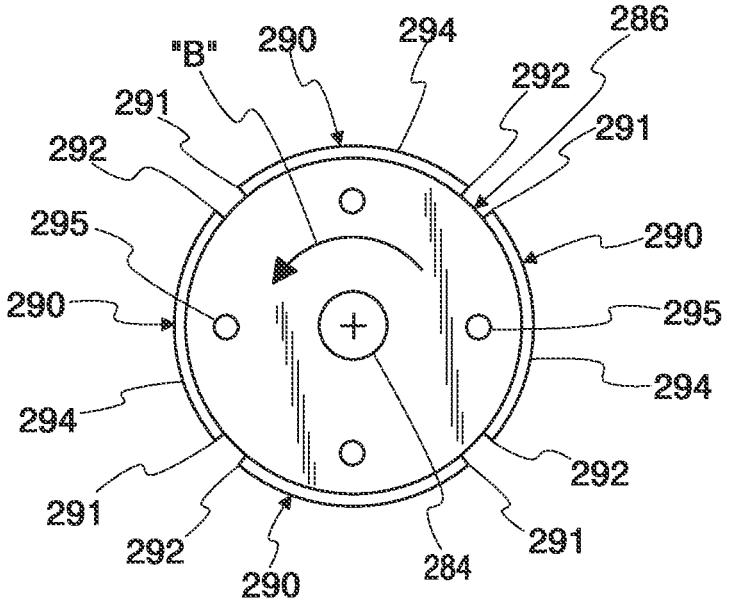
FIG. 10 is an end view of the rotary blade drum of the machine of FIG. 3.

Referring to FIGS. 9 to 11, a rotary blade drum assembly 280 is configured to operatively coact with the travelling web of film on base forming drum 220 in register with the continuous blade groove 238 of each mold configuration 224 to extract individual completed pouches 200 from the adhered films 202 and 204. As illustrated in the drawings, particularly FIGS. 3 and 11, the rotary blade drum assembly 280 is mounted in the rotary form, fill and seal machine with its rotational axis aligned with the rotational axis of the base forming drum 220.

Rotary blade drum assembly 280 is positioned downstream of the forming, filling and sealing stations and is thus arranged to engage the travelling web of adhered base and lid films 202 and 204 after formation of filled and sealed pouches 200, which, at this juncture, are integral to the adhered films. As is normal in such a machine, it is contemplated that the base film 202 remains under vacuum within the mold configuration cavities 224 through ports 245 (FIG. 6) until an individual pouch 200 is separated from the film. The pouches may then be deposited on a conveyor, such as conveyor 390, shown in FIG. 3, on release of the applied vacuum.

As can be appreciated and best seen in FIGS. 4 to 6, in the present disclosure, since the continuous perimeter separation land 240 surrounding continuous blade groove 238 of each mold configuration 224 are spaced apart some distance on the outer cylindrical surface of base forming drum 220, separation of each pouch 200 results in significant offal, sometimes referred to as a "net." Comprised of adhered films 202 and 204, the offal or net is accumulated and disposed of as will be explained.

Rotary blade drum assembly 280 is powered by the form, fill and seal machine to rotate in synchronization with the base forming drum 220 and in registry with mold configurations 224, and consequently, the advancing films 202 and 204 supported on film support surface 223 of drum 220. Rotary blade drum assembly 280 may be carried by a slidable carriage for translation toward and away from base forming drum 220 to operatively associate these for the pouch separation process. A servo-driven ball screw actuator, or any other suitable mechanism, may be employed to move the rotary blade drum assembly 280 relative to the forming drum 220.

The rotatable forming drum 220 and rotary blade drum assembly 280 may be powered, for example, by synchronous servo-motors with computerized control circuitry to ensure proper operational positioning and interaction. Rotary blade drum assembly 280 may be powered, as previously described, for controlled rotational movement about an axis parallel to the axis of rotation of base forming drum 220 in direction "B" shown in FIG. 3.

As seen in FIGS. 9, 10 and 11, rotary blade drum assembly 280 has a generally cylindrical roller portion 282 with an elongate bearing shaft 284 extending from its ends. Shaft 284 may be mounted upon previously described axially translatable carriage for controlled positioning in relation to base forming drum 220.

Rotary blade drum assembly 280 roller portion 282 has a drum outer cylindrical contact surface 286 defined by resilient insulating layers 288 and 297, described more fully below. The roller portion 282 has an axial length generally coextensive with the transverse width of base forming drum 220. When the base forming drum 220 and rotary blade drum assembly 280 are in operative association to each other, drum outer cylindrical contact surface 286 is in rolling contact with lid film 204 of the travelling web of adhered films 202 and 204. Of course, as explained, base film 202 is carried upon film support surface 223 of base forming drum 220, and is deformed by vacuum into the cavities of mold configurations 224, leading film retention chamber 243 and trailing film retention chambers 244.

The rotary blade drum assembly 280 is urged toward rotating base forming drum 220 to maintain this operating relationship. The effective diameter of the drum outer cylindrical contact surface 286, defined by the outer surfaces of insulating layer 288, is such that the outer film support surface 223 and the cylindrical drum contact surface 288 of rotary blade drum assembly 280 travel at the same linear velocity.

As seen in FIGS. 9 to 11, rotary blade drum assembly 280 includes generally circular separation blades 290 that extend radially outward of drum outer cylindrical contact surface 286 outward of layer 288. The blades 290 may be machined or otherwise formed or affixed to rotary blade drum assembly 280. They are shaped and positioned to interengage with the continuous blade grooves 238 surrounding the mold configurations 224 of the base forming drum 220.

In this illustrated embodiment, the blades 290 each include a distal edge 294 that extends radially outward of drum outer cylindrical contact surface 280. Blades 290 are configured to mesh with the generally circumferential continuous blade groove 238. The grooves 238 of each mold configuration surround each mold configuration 224. Consequently, the blades define perimeter edge 215 of each formed pouch 200. In this regard, each blade 290 forms a separation pattern sized and arranged to progressively engage the web of films 202 and 204 from leading edge 291 to trailing edge 292 within associated groove 238 and separate a single pouch 200 along the entire perimeter of each groove 238.

Blades 290 are circular in shape. In the direction of rotation of blade drum 280 each blade 290 leading edge at 291 first contacts the travelling web of adhered films 202 and 204 within a continuous blade groove 238. On contact with the films, the leading edge 291 initiates the separation process, which, by virtue of the rotation of base drum 220 and rotary blade drum assembly 280, progresses transversely and circumferentially about the perimeter land 230 until it completes separation at trailing edge 292. (See FIGS. 10 and 11).

As can be appreciated, the continuous blade groove 238 of each mold configuration 224 completely surrounds the entire circular perimeter edge 232 of continuous perimeter land 230 of the mold configuration. Cylindrical blades 290 are also sized and arranged to enter, sequentially, groove 238 and completely surround the continuous perimeter land 230 as the separation process proceeds. The interaction of the heated blades 290 and associated groove 238 forms the circular perimeter edge 215 and circular flange 211 of each separated pouch 200.

In accordance with the disclosure, the shape of the continuous perimeter groove 238 groove of each mold configuration and coacting blade 290 of the blade drum 280 can be any pattern desired. Examples of pouches with an irregular shaped perimeter flange are found in the previously mentioned U.S. Publication 2018/0137819. Exemplary of the capabilities available through implementation of the principles described here, the disclosure of U.S. Publication previously identified, shows other shapes that could be created with a pouch separation system having a rotary blade drum assembly operatively associated with a base forming drum containing a pattern of mold configurations with a blade receiving surrounding perimeter groove. These principles are applicable to such unique shapes as well as to rectangular or square shapes where a blade configuration forms the entire perimeter edge of the pouch.

As stated, the distal edges 294 of the blades 290 extend somewhat beyond the insulating layer 288. This allows the blades to enter the grooves 238 of base forming drum 220 without touching the drum. At maximum penetration, the distal edges 294 of the blades 290 enter the grooves 238, typically about ⅛" (inch) (3.175 mm.) and usually not less than 1/16" (inch) (1.58 mm.). Note that this dimension is important to extraction of each pouch 200 from the travelling web of adhered films 202 and 204. The greater the penetration, the higher the separation force applied to the web of films by the blades 290 within grooves 238.

The blades 290, one for each mold configuration of a long bar 221, are arranged in a transverse linear pattern along the length of the rotary blade drum 280. Hence, all pouches formed by mold configurations 224 in a single long bar 221 are separated from the film simultaneously. Here, each long bar includes eight mold configurations 224. Thus, each row of circular blades 290 of rotary blade drum includes eight blades 290. In the circumferential direction of rotation of rotary blade drum 280, the pattern of blades 290 advances sequentially from long bar to long bar of rotating base forming drum 220.

As illustrated, the rotary blade drum assembly 280 has four rows of blades spaced circumferentially of drum 280. The illustrated base forming drum 220 is comprised of numerous long bars 221 forming the cylindrical drum outer film support surface 223. Rotary blade drum assembly 280 has a diameter substantially smaller than the diameter of base forming drum 220. However, blades 290 are in register with grooves 238. Thus, the circumferential spacing between the leading edge 291 of one blade 290 and the leading edge 291 of the blade in the adjacent row must equal the distance between the leading and trailing edge 225 and 226 of a bar 221. As explained, the outer film support surface 223 and drum outer cylindrical contact surface 286 travel at the same linear velocity to maintain synchronous registry between the blades 290 and grooves 238.

It should be noted that in order to efficiently separate the web of adhered films and pouches, the rotary blade drum assembly 280 includes axial bores into which are inserted wound cartridge resistive heating elements 295, seen in FIG. 10. These heaters heat blades 290 to a temperature sufficient to melt and puncture the web of adhered films on contact, usually between 300° and 400° F. Of course, any suitable known heating arrangements may be utilized to heat the blades of blade drum assembly 280.

To prevent the heated rotary blade drum 280 from damaging the pouches 200 during separation, each intermediate area within the perimeter of cylindrical blades 290 is provided with insulating material in the form of the pads or discs 297. Such insulating pads or discs 297 may be made of silicone or other suitable material and have a durometer of 40 to 80. They may have a radial thickness of ½" (inch) or more. Notably, insulation layer 288 forming blade drum outer cylindrical contact surface 286 may be made from the same material.

Pads or discs 297 protect the pouches in the area within cylindrical blades 290 from undesired contact with heated metal elements of rotary blade drum assembly 280. FIG. 9 best illustrates the pads 297. Importantly, the insulating pads 297 contact each formed pouch of the travelling web of adhered films 202 and 204 and urge the pouches toward the associated mold configuration 224 in the base forming drum 220 during separation to restrict the tensioned film of the pouches against undesirable shape change. Such shape change could adversely affect pouch separation quality or effectiveness or result in damage to the separated pouches. The function of pads 297 and exemplary structural integration to the rotary blade drum assembly 280 is fully disclosed in previously mentioned U.S. Pat. No. 9,162,413. Separate insulating pads 297 may be secured within the blades 290 fasteners 293, best seen in FIG. 9.

Importantly, these rotary elements are disposed on opposite sides of the travelling web of films 202 and 204 with their respective axis of rotation spaced such to ensure that the distal ends 294 of blades 290 are in registry to fully enter groove 238, but without contact with the drum 220. This relationship, in turn, ensures a clean (sharply defined) perimeter edge 215 of the separated pouches 200.

The uncut sheets of PVA or other film formed with integral completed pouches is carried on the surface 223 of the forming drum 220. The pouches are held within the cavities of the mold configuration 224 and the combined base and lid films 202 and 204 are stretched taut against the smooth outer surface of drum 220 at each perimeter separation land 240 around mold configurations 224 by virtue of vacuum impressed within leading film retention chamber 243 and trailing film retention chambers 244. When the heated blade 290 of rotary blade drum assembly 280 enter the grooves 238, it melts through the film creating clean separation completely surrounding the pouch to form pouch perimeter edge 215.

The distal ends 294 of blades 290 may taper to a relatively sharp edge, about 1/32" (inch) or so. The shape concentrates the application of heat to the travelling web of adhered films to enhance penetration and formation of a precise edge for the pouch flange.

Notably, film 202 deposited within leading film retention chambers 243 and trailing film retention chambers 244 on generally cylindrical film support surface 223 of rotating drum 220, pass through all pouch processing stations, though no product feed occurs to these cavities. As explained, base film 202 is secured within the leading film retention chamber 243 and trailing film retention chambers 244 by virtue of the vacuum imposed through ports 246 throughout the pouch forming process. This securement of the base film 202 maintains it under tension in overlying relation to perimeter separation land 240 of each mold configuration 224.

Melting of the films 202 and 204 overlying each continuous blade groove 238 by a circular blade 290 occurs without disturbance of film position. Each of the film retention chambers do, however, receive an overlying portion of heated lid film 204 heated at station 340 and wetted at the wetting station 360 and then sealed or adhered to base film 202 at sealing system or station 370. The combined films 202 and 204, thereby, form unfilled or "phantom" pouches disposed in each leading retention chamber cavity 243 and trailing film retention chamber cavity 244, made of the same films, and by the same processing as the product containing pouches 200. On release of vacuum within the leading and trailing retention cavities, these pouches react in the same way (film shrinkage and pouch deformation).

As seen in FIG. 9, radial perforator pins 296 are employed in the areas of insulating layer 288 that overlay leading film retention chamber 243 and trailing film retention chambers 244. These pins perforate the lid film 204 overlying these chambers to deflate pressurized pouches in the web overlying the film retention pouches formed during application of lid film 204. This simplifies disposal of the remaining web (net) and minimizes the collection volume.

On termination of the vacuum to mold configurations 224, separated pouches 200 are deposited onto conveyor 390. The removal of completed pouches 200 from the travelling web of adhered films 202 and 204 results in a web remnant, largely intact, except for pouch-sized apertures corresponding to the shape of the blades 290, in this illustration circular. This PVA remnant is accumulated and disposed of by film disposal system 392, seen in FIG. 3. The disposal system may include power driven nip rollers 394 to pull the remnant web from the base forming drum 220 for disposal by a vacuum chopper device 396.

Figure 12:
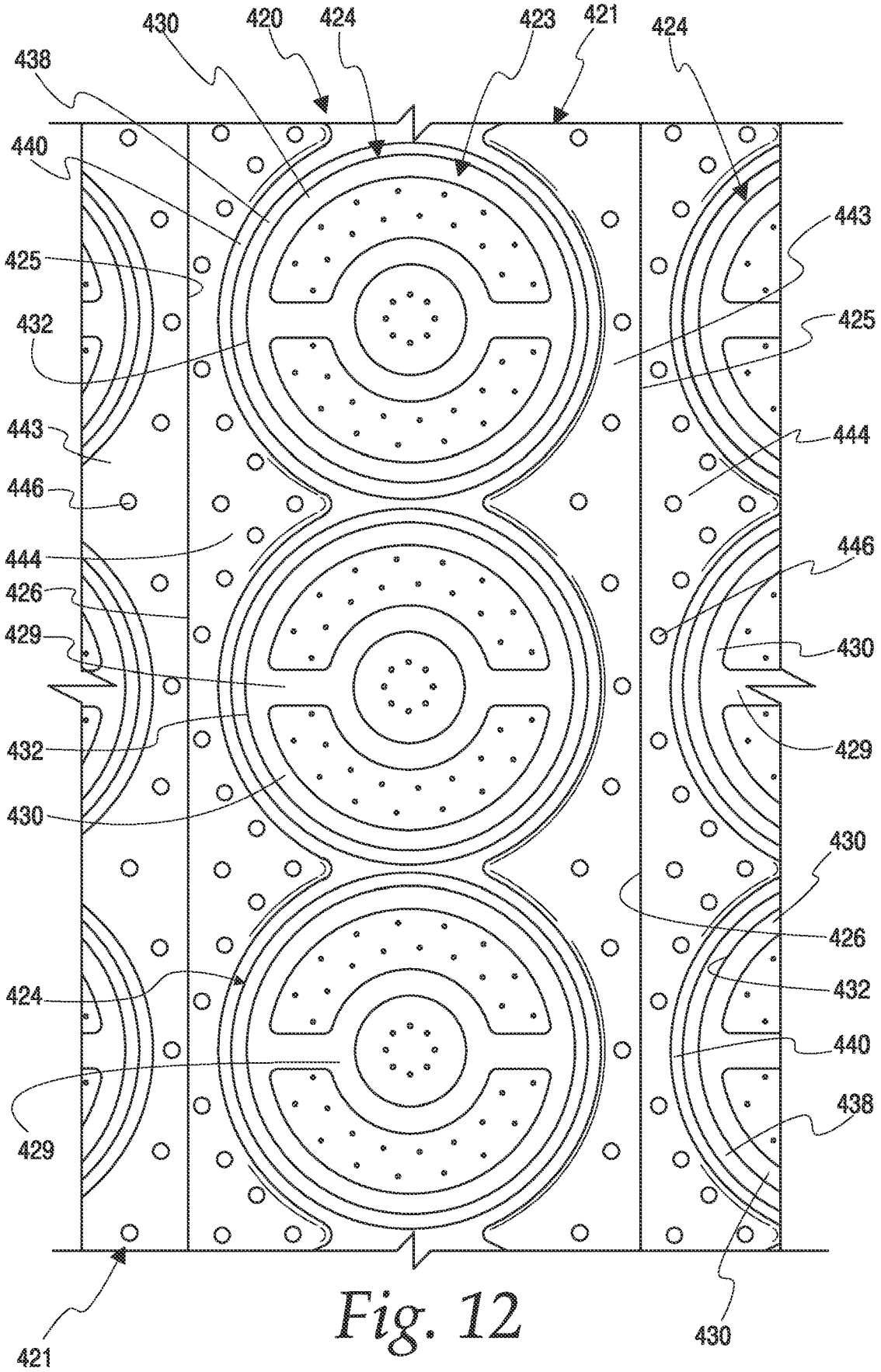
FIG. 12 is a partial plan view, on an enlarged scale, of an alternate form of the base forming drum of the disclosure.

Turning to FIG. 12, there is illustrated a modified form rotatable of base forming drum 420 comprised of long bars 421 extending transversely across a drum 420 parallel to the axis of rotation. The bars 421 are essentially the same as bars 221 of the base forming drum 220, seen in FIGS. 3 to 8, and include a series of transversely aligned mold configurations 424 defining cavities to form a pressurized product containing pouch of adhered polymeric films of a predetermined shape. A plurality of bars 421 are arranged in a side-to-side array, forming a wheel to define a generally cylindrical base film support surface 423. The assembled drum 420 is usable within a pouch form fill and seal machine, as illustrated in FIG. 3, which includes the previously described processing apparatus and functions.

The mold configurations 424 of bars 421 include a continuous perimeter land 430, surrounding a pouch defining cavity. A continuous blade groove 438 surrounds outer perimeter edge 432 of continuous perimeter land 430. A perimeter separation land 440 surrounds each mold configuration 424 and defines the radial width of continuous blade groove 438. The lands 430 and 440, as well as divider lands 429 of each mold configuration 424, define elements of the base forming drum outer generally cylindrical film support surface 423, as in the earlier embodiments. These elements of the mold configuration 424 operate as do the corresponding components described in connection with the embodiment of FIGS. 3 to 8.

Referring to FIG. 12, each long bar 421 includes a leading film retention chamber portion 443, adjacent leading edge 425, and a trailing film retention chamber portion 444 adjacent trailing edge 426. Each includes vacuum ports 446 to communicate with the machine vacuum system and provide vacuum to the film retention chamber portions.

With the bars assembled to form the base forming drum 420, leading edge 425 of each bar is disposed in facing contact with trailing edge 426 of each adjacent bar. Each such joint may be provided with a vacuum seal or gasket to ensure proper vacuum within the film retention cavity thus formed. As is illustrated in FIG. 12, the film retention cavities formed by portions 443 and 444 precede, and also trail, each transverse row of mold configurations 424 on each bar 421.

As in the previously described embodiment, vacuum impressed within the film retention cavities formed by joined portions 443 and 444, draws the base film into the cavities and secures it to the outer generally cylindrical film support surface of base forming drum 420, providing the film securement and stability for pouch separation at the separation station 380 of the form, fill and seal machine.

From this latter embodiment, it can be appreciated that the leading film retention chamber 443 and trailing retention chambers 444 and the long bars forming a base forming drum, can be provided in numerous forms. For example, in the embodiment of FIGS. 4 to 6, the single large film retention chamber 243 may be made the trailing retention chamber and the relatively small trailing retention chambers 244 may be made the leading retention chambers. The critical element resides in provision of retention cavities external to the mold cavities for base film securement. The resultant film stability is essential to the pouch separation process.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The invention claimed is:

1. Apparatus for forming product containing pouches from a travelling web of adhered films comprising a rotatable forming drum defining a film support surface, including a plurality of mold configurations disposed in transverse circumferentially spaced rows;

a film retention chamber in said film support surface preceding and trailing each of said mold configurations, including at least one leading film retention chamber preceding each said row of mold configurations and at least one trailing retention chamber trailing each transverse row of mold configurations, wherein said film support surface includes a perimeter separation land surrounding each said mold configuration, and a continuous perimeter land within each said mold configuration and a continuous blade groove formed between each said continuous perimeter land and the perimeter separation land surrounding each said mold configuration, and a pouch separation station with separation blades in synchronous register with said blade grooves to separate individual completed pouches from the travelling web of films, wherein said apparatus further includes a vacuum system including passages in said drum connecting to said mold configurations and passages in said drum connecting to said film retention chambers configured to provide vacuum to said mold configurations to retain the film within said mold configurations and to said film retention chambers to retain the film during separation of said pouches from the travelling web of films.

2. Apparatus for forming product containing pouches from a travelling web of adhered films, as claimed in claim 1, wherein said forming drum includes a leading film retention chamber preceding each row of mold configurations and a plurality of trailing retention chambers trailing each row of mold configurations.

3. Apparatus for forming product containing pouches from a travelling web of adhered films, as claimed in claim 2, wherein said leading film retention chambers include a leading land and extend between said perimeter separation lands and said leading land, and wherein said trailing film retention chambers include a trailing land and said trailing retention chambers extend between said perimeter separation land and said trailing land.

4. Apparatus for forming product containing pouches from a travelling web of adhered films, as claimed in claim 1, wherein said rotatable forming drum comprises a plurality of assembled long bars defining said outer film support surface, each said bar having a leading edge and a trailing edge and a row of mold configurations, each said long bar defining at least a portion of a film retention chamber preceding the row of mold configurations and at least a portion of a film retention chamber trailing the row of mold configurations.

5. Apparatus for forming product containing pouches from a travelling web of adhered films, as claimed in claim 4, wherein, each said bar includes a leading edge land and a trailing edge land, and wherein said bar defines said leading film retention chamber between said leading edge land and said perimeter separation lands and said at least one trailing film retention chamber between said trailing edge land and said perimeter separation lands.

6. Apparatus for forming product containing pouches from a travelling web of adhered films, as claimed in claim 5, wherein each said long bar includes said continuous perimeter land within each said mold configuration and said continuous blade groove formed between each said continuous perimeter land and the perimeter separation land surrounding said mold configuration.

7. Apparatus for forming product containing pouches from a travelling web of adhered films, as claimed in claim 4, wherein each said long bar includes passages communicating with said mold configurations and separate passages communicating with said film retention chambers.

8. Apparatus for forming product containing pouches from a travelling web of adhered films, as claimed in claim 1, wherein said vacuum system includes a vacuum source, a stationary vacuum distribution plate, including slots communicating with said vacuum source, at least one said slot disposed for communication with said passages in communication with said mold configurations and at least one said slot disposed for communication with said passages in communication with said film retention chambers.

9. Apparatus for forming product containing pouches from a travelling web of adhered films, as claimed in claim 8, wherein said drum includes ports connected to said passages in communication with said mold configurations, disposed for communication with said at least one of said slots in said distribution plate disposed for communications with said passages in communication with said mold configurations and ports connected to said passages in communication with said film retention chambers, disposed for communication with said at least one of said slots in said stationary distribution plate disposed for communication with said passages in communication with said film retention chambers.

10. Apparatus for forming product containing pouches from a travelling web of adhered films, as claimed in claim 9, wherein said rotary blade drum assembly includes perforator pins arranged to overlay said film retention chambers and perforate the travelling web of films.

11. A method for forming product containing pouches from a travelling web of adhered films with apparatus comprising, a film support surface including a plurality of mold configurations and a blade groove surrounding each said mold configuration, a film retention chamber in said film support surface preceding and trailing each of said mold configurations, a vacuum source connecting to said mold configurations and to said film retention chambers, separation blades in synchronous register with said blade grooves to separate individual completed pouches from the travelling web of films, said method comprising:

supporting a base film on said film support surface overlying said mold configurations to form a base film into said mold configurations and said film retention chambers to secure said base film overlying said mold configurations, applying vacuum to form said film into said mold configurations and said film retention chambers and forming product containing pockets within said mold configurations, filling product into said product containing pockets, applying a lid film to said base film to form the web of adhered films, maintaining said vacuum to said mold configurations until after filling said pockets and applying said lid film, operatively coacting said separation blades in register with said mold configurations to separate completed pouches from said travelling web of adhered films;

maintaining said vacuum to said film retention chambers until after separating said pouches.

12. The method for forming product containing pouches from a travelling web of adhered film, as claimed in claim 11, wherein, said apparatus further comprises a rotatable forming drum defining said film support surface, and said mold configurations are disposed in transverse rows circumferentially spaced about the film support surface; and said film retention chambers in said film support surface of said forming drum include at least one leading film retention chamber preceding each said row of mold configurations and at least one trailing retention chamber trailing each row of mold configurations, and said film support surface includes a perimeter separation land surrounding each said mold configuration, a continuous perimeter land within each said mold configuration, and a continuous blade groove formed between each said continuous perimeter land and each said perimeter separation land, a rotary blade drum assembly includes the separation blades in synchronous register with the blade grooves;

said method further comprising;

maintaining said base film under tension in overlying relation to said perimeter separation lands of said mold configurations during separation of the pouches by said separation blades of said blade drum assembly.

13. The method for forming product containing pouches from a travelling web of adhered film as claimed in claim 12, wherein said rotary blade drum assembly includes perforator pins arranged to overly said film retention chambers, said method further comprising:

forming pouches overlying said film retention chambers and piercing at least one of said films of said pouches overlying said film retention chambers with said perforator pins.

* * * * *